US006966116B2

(12) United States Patent
Peter et al.

(10) Patent No.: US 6,966,116 B2
(45) Date of Patent: Nov. 22, 2005

(54) SHAVING HEAD FOR A HAIR CUTTING APPARATUS

(75) Inventors: Andreas Peter, Kronberg (DE); Werner Haczek, Idstein (DE); Thosten Piesker, Bad Homburg (DE); Stefan Fürst, Kronberg (DE); Wolfgang Franke, Langen (DE)

(73) Assignee: Braun GmbH, Kronberg (DE)

( * ) Notice: Subject to any disclaimer, the term of this patent is extended or adjusted under 35 U.S.C. 154(b) by 0 days.

(21) Appl. No.: 10/969,270

(22) Filed: Oct. 20, 2004

(65) Prior Publication Data

US 2005/0050739 A1 Mar. 10, 2005

Related U.S. Application Data

(63) Continuation of application No. PCT/EP02/12882, filed on Nov. 18, 2002.

(30) Foreign Application Priority Data

Apr. 22, 2002 (DE) ..... 102 17 985

(51) Int. Cl.[7] ..... B26B 21/54
(52) U.S. Cl. ..... 30/346.51; 30/43.9; 30/43.92
(58) Field of Search ..... 30/346.51, 43.2, 30/43.7–43.92, 346.56–7

(56) References Cited

U.S. PATENT DOCUMENTS

| | | | | |
|---|---|---|---|---|
| 1,744,803 A | * | 1/1930 | Roth | 30/346.55 |
| 2,181,038 A | | 11/1939 | Wimberger et al | |
| 2,202,633 A | * | 5/1940 | Holsclaw | 30/43.3 |
| 2,272,123 A | | 2/1942 | Te Pas et al | |
| 2,773,306 A | * | 12/1956 | Ranson | 30/43.92 |
| 4,443,939 A | * | 4/1984 | Motta et al. | 30/49 |
| 4,603,477 A | * | 8/1986 | Francis | 30/50 |
| 4,630,370 A | | 12/1986 | Hamada | |
| 5,669,138 A | | 9/1997 | Wetzel | |

FOREIGN PATENT DOCUMENTS

| | | | | |
|---|---|---|---|---|
| DE | 680 697 | | 10/1939 | |
| DE | 43 12 060 | | 6/1994 | |
| FR | 849 978 | | 12/1939 | |
| GB | 2 280 632 | | 2/1995 | |
| JP | 54-26162 A | * | 2/1979 | 30/346.51 |

* cited by examiner

*Primary Examiner*—Allan N. Shoap
*Assistant Examiner*—Carolyn Blake
(74) *Attorney, Agent, or Firm*—Fish & Richardson P.C.

(57) ABSTRACT

The invention is directed to a shaving head for a hair cutting apparatus, with at least one outer cutter and at least one under cutter associated therewith and having cutting edges, said cutters being movable relative to one another by a drive mechanism, with the outer cutter having an engagement surface comprised of bars and slots, which slots are open at least towards one of two lateral boundary lines of the engagement surface, said boundary lines defining the width of the engagement, wherein the bars are shaped in a meandering, sinusoidal or serpentine configuration extending to and from between the two opposite lateral boundary lines of the engagement surface.

26 Claims, 2 Drawing Sheets

SHAVING HEAD FOR A HAIR CUTTING APPARATUS

CROSS-REFERENCE TO RELATED APPLICATIONS

This is a continuation of PCT Application No. PCT/EP02/12882, filed on Nov. 18, 2002, which claims priority to German Patent Application No. 102 17 985.9, filed on Apr. 22, 2002, which is incorporated herein by reference in its entirety.

TECHNICAL FIELD

This invention relates to a shaving head for a hair cutting apparatus, with at least one outer cutter and at least one under cutter associated therewith and having cutting edges, said cutters being movable relative to one another by a drive mechanism, with the outer cutter having an engagement surface comprised of bars and slots, which slots are open at least towards one of two lateral boundary lines of the engagement surface, said boundary lines defining the width of the engagement surface.

BACKGROUND

A shaving head of this type is known from DE 43 12 060 C1 and is used, for example, as a long-hair cutter in combination with a short-hair cutter assembly of an electric dry shaving apparatus. It finds preferred application when integrated as a central cutter between two shaving foils. The prior known shaving head has an under cutter comprised of a U-shaped blade having plural slots and driven to oscillate in the longitudinal direction. This blade is urged into contact with an outer cutter whose skin-engaging surface is situated on the side of the outer cutter facing away from the under cutter. This engagement surface is comprised of a center bar from which a plurality of tines arranged in the manner of a comb extend transversely to either side. The tines form cutting edges which in combination with the under cutter are able to cut hairs that have penetrated through the corresponding slots. The comb-type tines form boundaries for slots extending from the longitudinal side of the engagement surface until the center bar where they end. The longitudinally extending center bar therefore contributes to serving as a trap for the entered hairs, causing these hairs to be held captive in the shaving head until a cutting event takes place. In the known shaving head the length of the cutting edges of the outer cutter is slightly less than half the width of the outer cutter.

Whilst the known shaving head has proven successful in practice, there is the risk, in particular at an elevated advancing speed of the hair cutting apparatus, of a hair, which is initially trapped between the tines, being caught as late as on the center bar, but being subsequently pulled over this bar, so that it is outside the range of the cutting edges before a cutting event has taken place. In order to diminish the probability of such a case occurring with the prior known shaving head, it would be necessary to extend the cutting edges, that is, the length of the tines or the slots, considerably, which would result in significantly larger dimensions of the shaving head.

It is therefore an object of the present invention to provide a shaving head of the type identified in the preamble, which is distinguished by particularly high effectiveness also at elevated advancing speeds of the hair cutting apparatus while yet being of a very compact size.

SUMMARY

According to an aspect of the present invention, this object is accomplished in that the bars are shaped in a meandering, sinusoidal or serpentine configuration extending to and fro between the two opposite lateral boundary lines of the engagement surface. With such bars, it is possible to obtain cutting edges of a length amounting to approximately the width of the engagement surface, that is, the shaving head width. These extended cutting edges increase the probability that a hair, once it is in threaded into the slot with the hair cutting apparatus advancing, is actually cut. Even with the hair cutting apparatus advancing at an elevated speed, it is not possible for the hair to slip out of the slot in such a short time, but rather it is held captive between the bars until it is cut.

In the prior known shaving head, the outer cutter almost exclusively takes support from the under cutter with the center bar providing, so to speak, a single-track support. With these bars, this guidance takes place in the region of the reversal points of the meanders. Accordingly, the guide is comprised of interrupted sections situated in alternating fashion in the area of the one or the other lateral boundary line. The under cutter is guided as on two laterally outer lying rails. This represents an optimal guide of the two cutting elements.

The shaving head geometries, that is, the engagement surfaces of the aggregate of shaving surfaces, may be designed very differently, thus in one embodiment of the invention provision is made for the two lateral boundary lines to be parallels forming the longitudinal sides of the engagement surface. According to another embodiment of the invention, the two lateral boundary lines are designed as nesting, in particular concentric circles forming the outer and, respectively, the inner circumference of the engagement surface. In this way, rectangular or annular shaving surfaces may be formed, for example.

In order to improve the lifting of hairs lying flat against the skin, in a preferred embodiment of the invention provision is made for the first and/or second lateral boundary line to protrude beyond the corresponding lateral boundaries of the associated under cutter, so that single or several reversal regions of the bars project in comb-like fashion relative to the under cutter. This results in a particularly good threading and lifting effect. This effect is enhanced even further by providing for the width of the slots to expand in the opening direction in a funnel-shaped configuration.

The length of the slots is advantageously dimensioned such that the end of the slots opposite the aperture lies within the area swept by the cutting edges of the under cutter. This results in a particularly stable mounting of the cutting elements moved relative to one another and counteracts any interlocking of the respective cutting edges. Also serving to prevent interlocking is a construction in which the slots or bars of the outer cutter are spaced in a manner different from the spacing of the cutting edges of the under cutter.

This shaving head may find application in systems driven in a linear oscillatory as well as rotary manner.

Further objects, features, advantages and application possibilities of the present invention will become apparent from the subsequent description of an embodiment. It will be understood that any single feature or any combination of single features described or represented by illustration form the subject-matter of the present invention, irrespective of their summary in the claims or their back-references.

DETAILED DESCRIPTION

Figure 1:
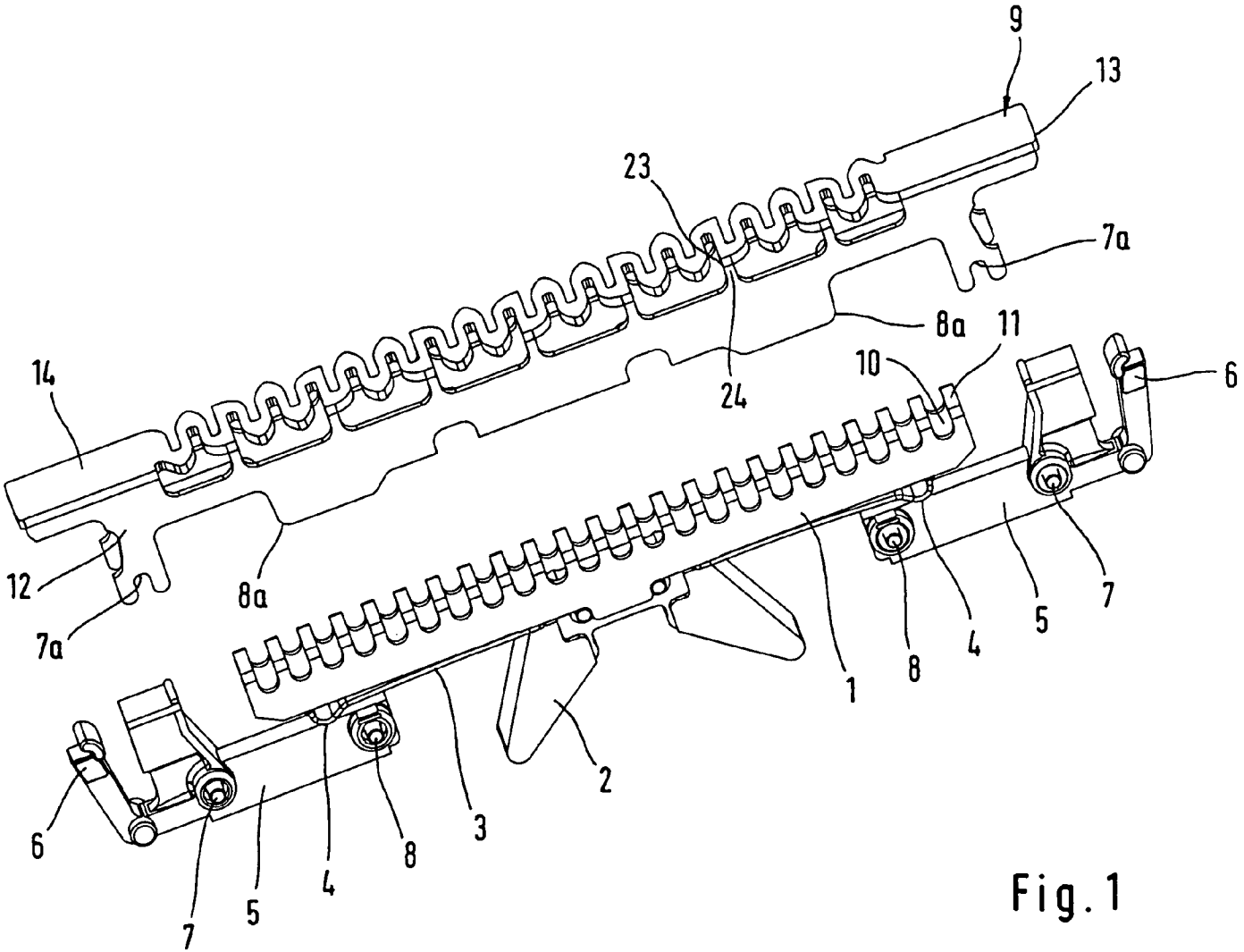
FIG. 1 is an exploded view of a shaving head having an outer cutter with meandering cutting bars.

The shaving head shown in FIG. 1 is provided with an under cutter 1 having a coupling member 2 for connection to an electric drive mechanism, not shown, of the hair cutting apparatus, the drive mechanism being, for example, a driven eccentric shaft or oscillating bridge. By means of the drive mechanism the under cutter 1 is drivable in oscillatory manner in longitudinal direction. Also secured to the under cutter 1 is a bias spring 3 which is constructed as a bent leaf spring bearing with its end portions 4 against a respective support 5. The supports 5 have respective detent lugs 6 suitable for latching in a housing, not shown in the drawing, or a component connected with the housing, in particular in the removable frame of a shaving system of a hair cutting apparatus. The supports 5 have at either end outboard and inboard welding spots 7 and 8, respectively, by means of which they may be welded to corresponding mating surfaces 7*a* and 8*a,* respectively, on the outer cutter 9.

When the supports 5 and the outer cutter 9 are welded together, the under cutter 1 is biased against, and into permanent contact with, the outer cutter 9 by the bias spring 3.

The under cutter is constructed as a U-shaped profile having two legs, which extend downwardly, and on its upper side a plurality of transversely extending parallel notches 10 separated by bars 11 which form the cutting edges of the blade.

The outer cutter 9 is comprised of two parallel side walls 12 on which the mating surfaces 7*a* and 8*a* are provided, as well as of a further strip-shaped wall element 13 that interconnects the two side walls 12. The outer surface of this wall element 13 forms the engagement surface 14 of the shaving head. In assembled condition, the side walls 12 and the wall element 13 serve as guide for the driven under cutter 1, encompassing it.

Figure 2:
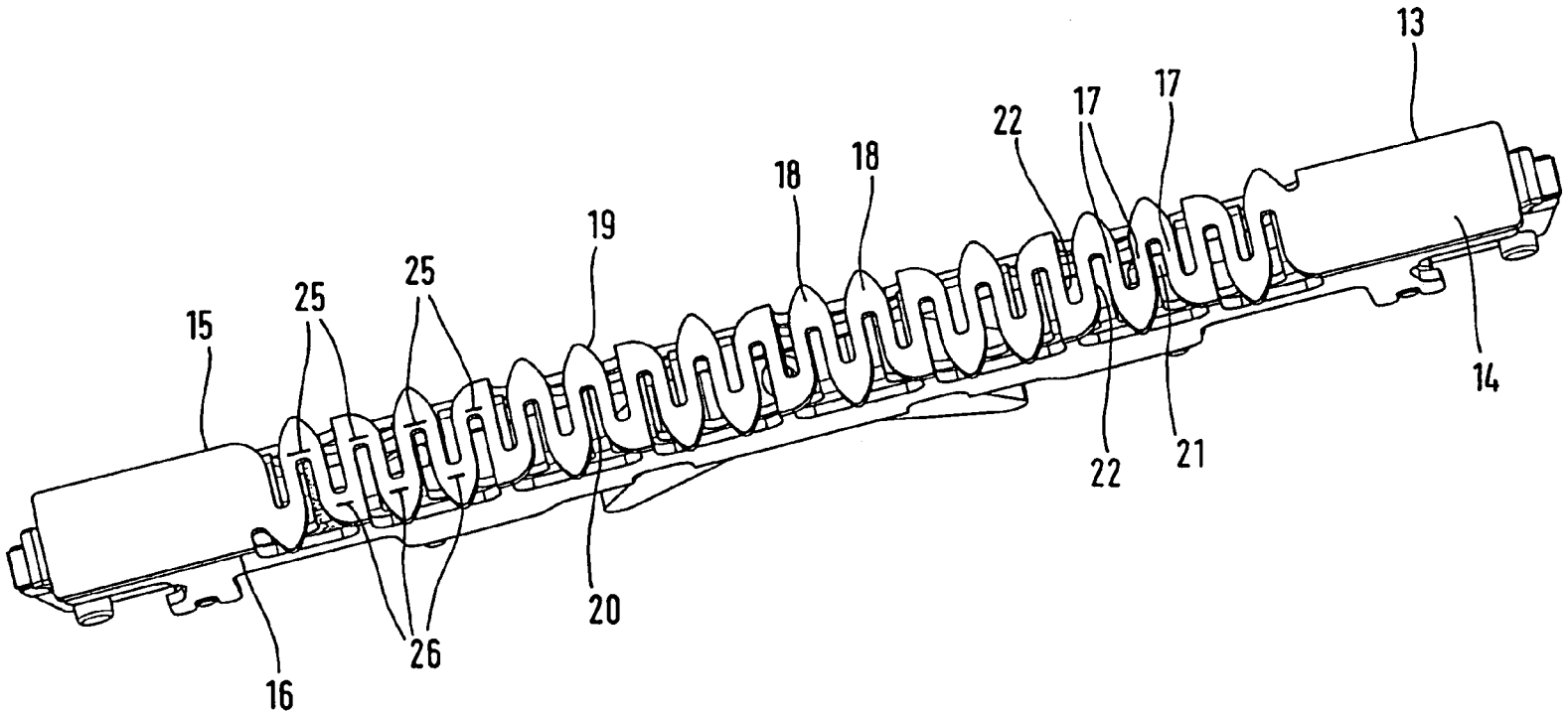
FIG. 2 is a plan view of the shaving head shown in FIG. 1.

As emerges particularly clearly from FIG. 2, the width of the engagement surface 14 is defined by two lateral boundary lines 15 and 16 which have a plane contour in the area of their end portions lying opposite each other in longitudinal direction. Situated between these end portions is the actual cutting zone in which the engagement surface 14 of the outer cutter 9 is formed by interconnected bars 17 extending in a meandering, sinusoidal or serpentine fashion.

The bars 17 have transversely extending sections forming the cutting edges 22, as well as reversal points 18 with outwardly pointing larger radii 19 and inner lying small radii 20. The large radii 19 form the tips of comb teeth which on account of their large radii are particularly gentle on the skin. The small radii 20 provide for connection between the cutting edges 22 and are dimensioned at least to exceed the radius of a hair. In this way it is ensured that hairs caught between the cutting edges 22 cannot be pinched and hence pulled.

While in the prior known shaving head the outside radius of the transversely extending comb-type bars reaches maximally the dimension of half the bar width, the maximum outside radius 19 of the shaving head of the invention may be dimensioned to amount to the full width of the bar plus half the width of the slot.

At some of the reversal points 18 the outside radius 19 continues abruptly in a right angle; these are the points 23 where the wall element 13 is welded to the supports 24 formed integrally with the side walls 12. The abutment surface formed by the right angle at the point 23 serves an adjusting and locating function in the welding apparatus. It will be understood, of course, that the present invention may also be carried into effect without these corners at the points 23, in which case all the reversal points have large radii 19 at the tips of the comb teeth.

The radii 19 furthermore define threading zones for the slots 21, the threading zones expanding outwardly between adjacent reversal regions 18 so that the widths of the slots expand towards the open ends of the slots.

The aggregate of the meander-shaped bars 17 with their arcuate reversal points 18 where they are connected to the side walls 12 in part through the supports 24 presents a relatively elastic engagement surface 14 for the skin to be shaved. This surface is capable of conforming itself to skin contours at least to a small degree and of getting around irregular contours, if any, more easily than prior known shaving heads. Even if the engagement surface 14 is deformed in the region of the cutting zone it is ensured that interlocking with the bars 11 of the under cutter 1 cannot occur. For this reason not only does the spacing of the bars 17 of the outer cutter 9 differ from the spacing of the bars 11 of the under cutter 1, but also the length of the slots 21 is dimensioned such that in assembled condition they end within the area swept by the bars 11 of the under cutter 1. In this manner the risk of interlocking is excluded even when the meanders are bent about the longitudinal axis of the shaving head. This swept area, that is, the contact area between the outer cutter 9 and the under cutter 1, is designated as 25 and 26 in FIG. 2. Reference numerals 25 and 26 indicate, so to speak, the two outer tracks through which the under cutter 1, loaded by the bias spring 13, bears against the outer cutter 9.

With the above-described construction of the shaving head it is possible to obtain particularly long slots 21 with correspondingly long cutting edges whose comb tooth tips have particularly large outside radii 19. This enables shaving heads to be constructed that cut particularly effectively in addition to ensuring an optimally gentle treatment of the skin.

What is claimed is:

1. A shaving head for a hair cutting apparatus, with at least one outer cutter and at least one under cutter associated therewith and having cutting edges, said cutters being movable relative to one another, with the outer cutter having an engagement surface of a width defined between two opposite lateral boundary lines, the engagement surface comprised of interconnected bars defining slots therebetween, the slots open towards one of the lateral boundary lines of the engagement surface, wherein the interconnected bars extend back and forth across the engagement surface between the lateral boundary lines in a substantially serpentine configuration with adjacent bars interconnected at arcuate reversal regions such that longitudinally adjacent slots open towards opposite sides of the engagement surface.

2. The shaving head as claimed in claim 1, wherein said two lateral boundary lines are longitudinal sides of the engagement surface.

3. The shaving head as claimed in claim 1, wherein said two lateral boundary lines are concentric circles forming outer and inner circumferences of the engagement surface.

4. The shaving head as claimed in claim 2, wherein at least one of the lateral boundary lines protrudes beyond corresponding lateral boundaries of the associated under cutter, so that at least one reversal region of the bars projects in comb-like fashion relative to the under cutter.

5. The shaving head as claimed in claim 2, wherein widths of the slots expand towards open ends of the slots.

6. The shaving head as claimed in claim 2, wherein a length of each slot is such that a closed end of each slot, opposite an open end, lies over an area swept by the cutting edges of the under cutter.

7. The shaving head as claimed in claim 2, wherein said bars of the outer cutter have a different spacing than the cutting edges of the under cutter.

8. The shaving head as claimed in claim 7, wherein relative motion between the outer cutter and the under cutter is an oscillatory linear motion.

9. The shaving head as claimed in claim 3, wherein relative motion between the outer cutter and the under cutter is a rotary motion.

10. The shaving head as claimed in claim 3, wherein at least one of the lateral boundary lines protrudes beyond corresponding lateral boundaries of the associated under cutter, so that at least one reversal region of the bars projects in comb-like fashion relative to the under cutter.

11. The shaving head as claimed in claim 3, wherein widths of the slots expand towards open ends of the slots.

12. The shaving head as claimed in claim 3, wherein a length of each slot is such that a closed end of each slot opposite an open end lies over an area swept by the cutting edges of the under cutter.

13. The shaving head as claimed in claim 3, wherein said bars of the outer cutter have a different spacing than the cutting edges of the under cutter.

14. The shaving head as claimed in claim 1 wherein the serpentine configuration is substantially sinusoidal.

15. The shaving head as claimed in claim 1 wherein the serpentine configuration extends across an entire width of the engagement surface as defined by the opposite lateral boundary lines.

16. A shaving head for a hair cutting apparatus, the shaving head comprising:

an outer cutter having a cutting surface extending between two lateral boundary lines, the cutting surface comprising bars extending between arcuate reversal regions located at the boundary lines, adjacent cutting bars defining slots, each slot extending from an opening between the adjacent bars at one lateral boundary line to the reversal region where the adjacent bars connect at the other lateral boundary.

17. The shaving head as claimed in claim 16 wherein the reversal points have outer radii greater than half a width of the bars.

18. The shaving head as claimed in claim 16, further comprising an under cutter associated with the outer cutter and having cutting edges, the cutters movable relative to each other.

19. The shaving head as claimed in claim 18 wherein at least one of the lateral boundary lines protrudes beyond corresponding lateral boundaries of the associated under cutter, so that at least one reversal region projects in comb-like fashion relative to the under cutter.

20. The shaving head as claimed in claim 19, wherein a length of each slot is such that an end of each slot opposite the opening lies over an area swept by the cutting edges of the under cutter.

21. The shaving head as claimed in claim 18, wherein the lateral boundary lines are substantially parallel longitudinal sides of an engagement surface and relative motion between the outer cutter and the under cutter is an oscillatory linear motion.

22. The shaving head as claimed in claim 18, wherein the lateral boundary lines are concentric circles forming outer and inner circumferences of an engagement surface and relative motion between the outer cutter and the under cutter is a rotary motion.

23. A hair cutter comprising a shaving head for a hair cutting apparatus, the shaving head comprising:

an outer cutter having a cutting surface extending between two lateral boundary lines, the cutting surface comprising bars extending between arcuate reversal regions located at the boundary lines, adjacent cutting bars defining slots, each slot extending from an opening between the adjacent bars at one lateral boundary line to the reversal region where the adjacent bars connect at the other lateral boundary.

24. A method of cutting hair, the method comprising:

providing a hair cutting appliance comprising a shaving head for a hair cutting apparatus, the shaving head comprising: an outer cutting having a cutting surface extended between two lateral boundary lines, the cutting surface comprising bars extending between arcuate reversal regions located at the boundary lines, adjacent cutting bars at one lateral boundary line to the reversal region where the adjacent bars connect at the other lateral boundary;

activating the hair cutting appliance; and engaging hair with the hair cutting appliance so that, as the hair cutting appliance advances, the bars cut hair that enters the slots through the openings.

25. The method as claimed in claim 24, wherein the lateral boundary lines are substantially parallel longitudinal sides of an engagement surface and relative motion between the outer cutter and an under cutter is an oscillatory linear motion.

26. The method as claimed in claim 24, wherein the lateral boundary lines are concentric circles forming outer and inner circumferences of an engagement surface and relative motion between the outer cutter and an under cutter is a rotary motion.

* * * * *

UNITED STATES PATENT AND TRADEMARK OFFICE

CERTIFICATE OF CORRECTION

PATENT NO. : 6,966,116 B2 
APPLICATION NO. : 10/969270
DATED : November 22, 2005
INVENTOR(S) : Peter et al.

It is certified that error appears in the above-identified patent and that said Letters Patent is hereby corrected as shown below:

Title page,
Item [75], Inventors, delete "Thosten" and insert -- Thorsten --.

Column 6,
Line 37, delete "extended" and insert -- extending --.
Line 40, between "bars" and "at one" insert --defining slots, each slot extending from an opening between the adjacent bars --.

Signed and Sealed this

Twenty-seventh Day of June, 2006

JON W. DUDAS
*Director of the United States Patent and Trademark Office*